US009200484B2

(12) United States Patent
Cleboski et al.

(10) Patent No.: US 9,200,484 B2
(45) Date of Patent: Dec. 1, 2015

(54) SUPERABRASIVE-IMPREGNATED EARTH-BORING TOOLS WITH EXTENDED FEATURES AND AGGRESSIVE COMPOSITIONS, AND RELATED METHODS

(71) Applicants: Christopher J. Cleboski, Houston, TX (US); Scott F. Donald, The Woodlands, TX (US)

(72) Inventors: Christopher J. Cleboski, Houston, TX (US); Scott F. Donald, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 371 days.

(21) Appl. No.: 13/745,392

(22) Filed: Jan. 18, 2013

(65) Prior Publication Data

US 2013/0186694 A1 Jul. 25, 2013

Related U.S. Application Data

(60) Provisional application No. 61/589,112, filed on Jan. 20, 2012.

(51) Int. Cl.

| | |
|---|---|
| ***E21B 10/55*** | (2006.01) |
| ***E21B 10/50*** | (2006.01) |
| ***E21B 10/58*** | (2006.01) |
| ***E21B 10/60*** | (2006.01) |

(52) U.S. Cl.

CPC ..... *E21B 10/50* (2013.01); *E21B 10/55* (2013.01); *E21B 10/58* (2013.01); *E21B 10/602* (2013.01)

(58) Field of Classification Search

CPC ..... E21B 10/43; E21B 10/46

See application file for complete search history.

(56) References Cited

U.S. PATENT DOCUMENTS

| | | | | |
|---|---|---|---|---|
| 3,106,973 | A | 10/1963 | Christensen | |
| 3,283,836 | A * | 11/1966 | North et al. | 175/405.1 |
| 3,696,875 | A | 10/1972 | Cortes | |
| 4,128,136 | A | 12/1978 | Generoux | |
| 4,718,505 | A | 1/1988 | Fuller | |
| 4,719,979 | A | 1/1988 | Jones | |
| 5,099,935 | A | 3/1992 | Anthon et al. | |
| 6,095,265 | A | 8/2000 | Alsup et al. | |
| 6,193,000 | B1 * | 2/2001 | Caraway et al. | 175/431 |
| 6,458,471 | B2 | 10/2002 | Lovato et al. | |
| 6,742,611 | B1 | 6/2004 | Illerhaus et al. | |

(Continued)

OTHER PUBLICATIONS

International Search Report for International Application No. PCT/US2013/021797 dated May 15, 2013, 5 pages.

(Continued)

*Primary Examiner* — William P Neuder

(74) *Attorney, Agent, or Firm* — TraskBritt

(57) ABSTRACT

A superabrasive-impregnated earth-boring rotary drill bit includes cutting features extending outwardly from a bit body in a nose region of the drill bit. The cutting features comprise a composite material including superabrasive particles embedded within a matrix material. The cutting features extend from an outer surface of the bit body by a relatively high average distance. Methods of forming a superabrasive-impregnated earth-boring rotary drill bit include the formation of cutting features that extend outwardly from a bit body of a drill bit in a nose region of the drill bit. The cutting features are formed to comprise a particle-matrix composite material that includes superabrasive particles embedded within a matrix material. The cutting features are further formed such that they extend from the outer surface of the bit body by a relatively high average distance.

20 Claims, 5 Drawing Sheets

(56) References Cited

U.S. PATENT DOCUMENTS

| | | | | |
|---|---|---|---|---|
| 2008/0245576 | A1* | 10/2008 | Liang et al. | 175/374 |
| 2010/0122853 | A1 | 5/2010 | Scott et al. | |
| 2011/0000715 | A1 | 1/2011 | Lyons et al. | |
| 2011/0005837 | A1 | 1/2011 | Hoffmaster et al. | |
| 2011/0142707 | A1 | 6/2011 | Choe et al. | |
| 2013/0153306 | A1* | 6/2013 | Burhan et al. | 175/406 |

OTHER PUBLICATIONS

International Written Opinion for International Application No. PCT/US2013/021797 dated May 15, 2013, 6 pages.

International Preliminary Report on Patentability for International Application No. PCT/US2013/021797 dated Jul. 22, 2014, 7 pages.

ASTM International Test Method B611-85(2000)e1, "Standard Test Method for Abrasive Wear Resistance of Cemented Carbides", vol. 02.05, Issued (May 2005).

* cited by examiner

SUPERABRASIVE-IMPREGNATED EARTH-BORING TOOLS WITH EXTENDED FEATURES AND AGGRESSIVE COMPOSITIONS, AND RELATED METHODS

CROSS-REFERENCE TO RELATED APPLICATION

This application claims the benefit of U.S. Provisional Patent Application Ser. No. 61/589,112, filed Jan. 20, 2012, the disclosure of which is hereby incorporated herein in its entirety by this reference.

FIELD

Embodiments of the present disclosure generally relate to earth-boring tools, such as rotary drill bits, that include cutting structures that are impregnated with diamond or other superabrasive particles, and to methods of manufacturing and using such earth-boring tools.

BACKGROUND

Earth-boring tools are commonly used for forming (e.g., drilling and reaming) bore holes or wells (hereinafter "wellbores") in earth formations. Earth-boring tools include, for example, rotary drill bits, coring bits, eccentric bits, bi-center bits, reamers, under-reamers, and mills.

Different types of earth-boring rotary drill bits are known in the art including, for example, fixed-cutter bits (which are often referred to in the art as "drag" bits), rolling-cutter bits (which are often referred to in the art as "rock" bits), superabrasive-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end that extends into the wellbore from the surface of the formation. Various tools and components, including the drill bit, are often coupled together at the distal end of the drill string at the bottom or end of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is attached, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Superabrasive-impregnated earth-boring rotary drill bits and other tools may be used for drilling hard or abrasive rock formations such as sandstones. Typically, a superabrasive-impregnated bit has a solid body, which is often referred to in the art as a "crown," that is cast in a mold. The crown is attached to a steel shank having a threaded end that may be used to attach the crown and steel shank to a drill string. The crown may have a variety of configurations and generally includes a cutting face comprising a plurality of cutting structures, which may comprise at least one of cutting segments, posts, and blades. The posts and blades may be integrally formed with the crown in the mold, or they may be separately formed and attached to the crown. Channels separate the posts and blades to allow drilling fluid to flow over the face of the bit.

Superabrasive-impregnated drill bits may be formed such that the cutting face of the drill bit (including the segments, posts, blades, etc.) comprises a particle-matrix composite material that includes superabrasive particles dispersed throughout a matrix material. The superabrasive particles may comprise diamond or cubic boron nitride. The matrix material itself may comprise a particle-matrix composite material. For example, the superabrasive particles may be embedded in a material that includes tungsten carbide particles embedded within a metal matrix, such as a copper-based metal alloy.

While drilling with a superabrasive-impregnated drill bit, the matrix material surrounding the superabrasive particles wears at a faster rate than do the superabrasive particles. As the matrix material surrounding the superabrasive particles on the surface of the bit wears away, the exposure of the superabrasive particles at the surface gradually increases until the superabrasive particles eventually fall away from the drill bit. As some superabrasive particles are falling away, others that were previously completely buried in the matrix material become exposed at the surface of the matrix material, such that fresh, sharp superabrasive particles are continuously being exposed and used to cut the earth formation.

Typically, a superabrasive-impregnated bit is formed by mixing and distributing superabrasive particles (e.g., diamond particles or cubic boron nitride particles) and other hard particles (e.g., tungsten carbide particles) in a mold cavity having a shape corresponding to the bit to be formed. The particle mixture is then infiltrated with a molten metal matrix material, such as a copper-based metal alloy. After infiltration, the molten metal matrix material is allowed to cool and solidify. The resulting superabrasive-impregnated bit may then be removed from the mold. Alternatively, a mixture of superabrasive particles, hard particles, and powder matrix material may be pressed and sintered in a hot isostatic pressing (HIP) process to form superabrasive-impregnated blades, posts, or other segments, which may be brazed or otherwise attached to a separately formed bit body.

BRIEF SUMMARY

In some embodiments, the present disclosure includes a superabrasive-impregnated earth-boring rotary drill bit that comprises a bit body, and cutting features extending outwardly from the bit body in a nose region of the drill bit. The cutting features define a plurality of fluid channels extending over the bit body between the cutting features. The cutting features comprise a particle-matrix composite material including superabrasive particles embedded within a matrix material. The cutting features that extend outwardly from the bit body in the nose region of the drill bit extend from the outer surface of the bit body within the fluid channels by an average distance of at least about 2.54 centimeters (1.00 inch).

In additional embodiments, the present disclosure includes a method of forming a superabrasive-impregnated earth-boring rotary drill bit. In accordance with the method, cutting features are formed that extend outwardly from a bit body of the drill bit in a nose region of the drill bit. The cutting features thus formed define a plurality of fluid channels extending over the bit body between the cutting features. The cutting features are formed to comprise a particle-matrix composite material that includes superabrasive particles embedded within a matrix material. The cutting features are formed such that they extend from the outer surface of the bit body within the fluid channels by an average distance of at least about 2.54 centimeters (1.00 inch).

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

The illustrations presented herein are not actual views of any particular earth-boring tool, cutting element, or component thereof, but are merely idealized representations that are employed to describe embodiments of the present disclosure.

As used herein, the term "earth-boring tool" means and includes any tool used to remove formation material and faun a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

Figure 1:
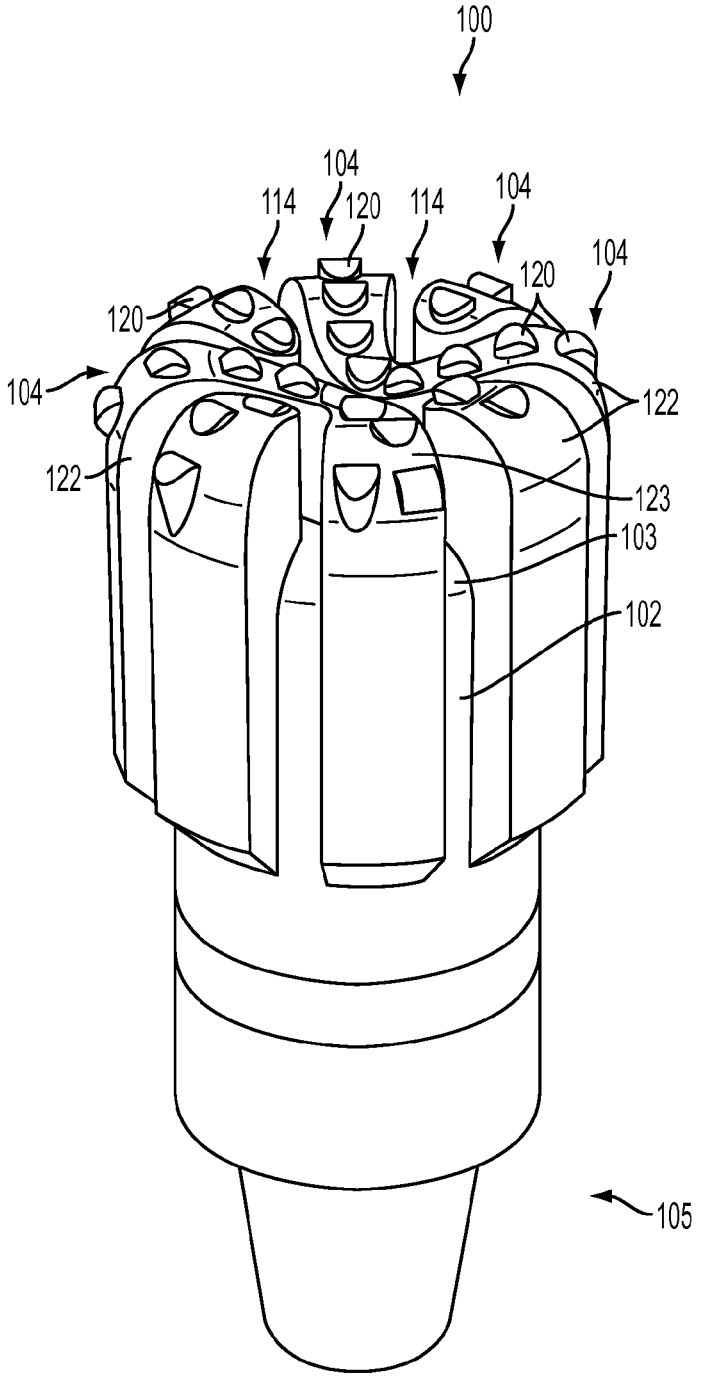
FIG. 1 is an isometric view of a super-abrasive impregnated earth-boring tool in the form of a rotary drill bit.

FIG. 1 is a perspective view of a superabrasive impregnated earth-boring tool in the form of a rotary drill bit 100. The drill bit 100 includes a bit body 102, and cutting features 104 that extend outwardly from the bit body 102. The drill bit 100 also includes a connection end 105 that is adapted for coupling of the drill bit 100 to a drill pipe or another component of what is referred to in the art as a "bottom hole assembly" (BHA).

Figure 2:
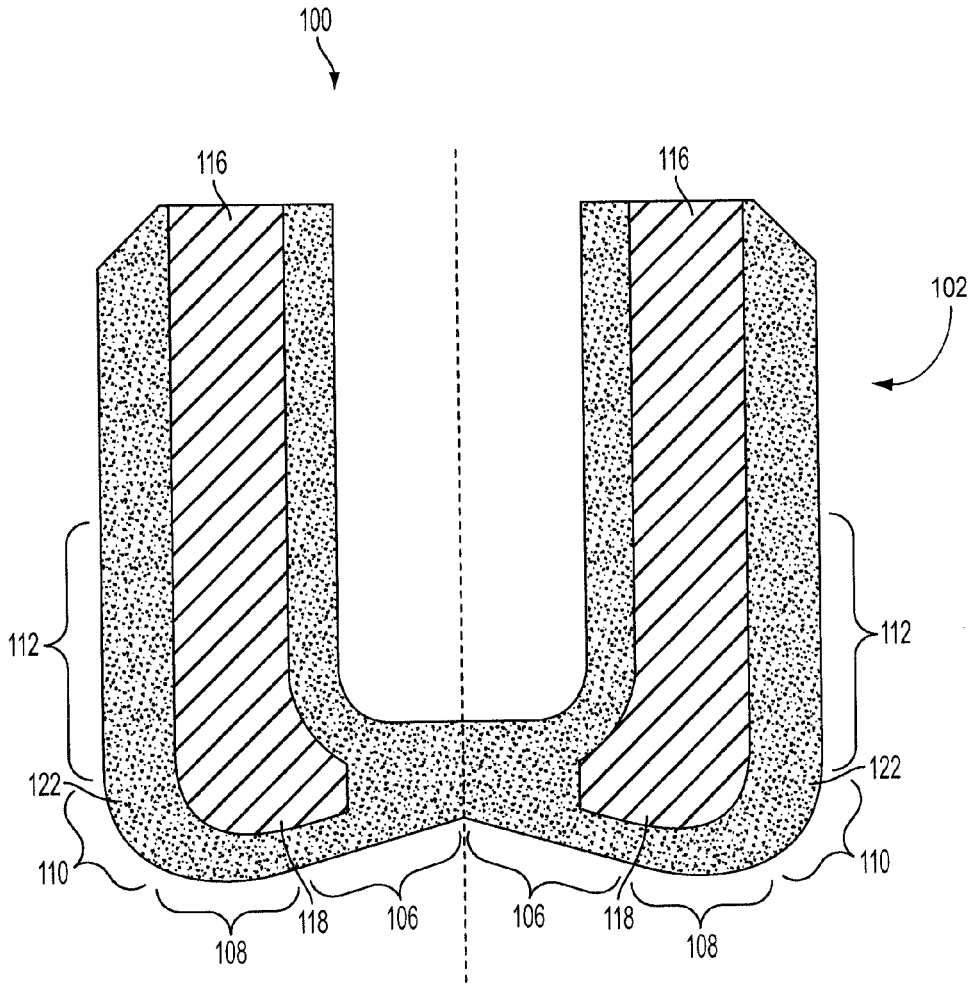
FIG. 2 is a simplified longitudinal cross-sectional view of a bit body of the drill bit of FIG. 1.

FIG. 2 is a simplified cross-sectional side view of the bit body 102. As shown in FIG. 2, the outer face of the bit body 102 may include a central inverted cone region 106, a nose region 108, a shoulder region 110, and a gage region 112. The drill bit 100 may include cutting features 104 (FIG. 1) in each of these regions 106, 108, 110, 112, or cutting features 104 having portions that extend over one or more of these regions 106, 108, 110, 112.

Referring again to FIG. 1, the cutting features 104 may define a plurality of fluid channels 114 that extend over the bit body 102 between the cutting features 104. During drilling, drilling fluid may be pumped from the surface of the formation down the wellbore through a drill string to which the drill bit 100 is coupled, through the drill bit 100 and out fluid ports therein. The drilling fluid then flows across the face of the drill bit 100 through the fluid channels 114 to the annulus between the drill pipe and the wellbore, where it flows back up through the wellbore to the surface of the formation. The drilling fluid may be circulated in this manner during drilling to flush cuttings away from the drill bit 100 and up to the surface of the formation, and to cool the drill bit 100 and other equipment in the drill string.

The cutting features 104 may comprise any of a number of different types of cutting structures known in the art for use in superabrasive-impregnated earth-boring tools. For example, the cutting features 104 may comprise one or more of segments, posts, and blades. In the non-limiting embodiment shown in FIG. 1, the cutting features 104 include posts 120 and blades 122. In particular, the bit body 102 of the drill bit 100 includes a plurality of blades 122, each of which blades 122 carries a plurality of posts 120. The posts 120 extend into the blades 122 from the outer surfaces of the blades 122, and also protrude outwardly from the outer surfaces 123 of the blades 122.

Figure 3A:
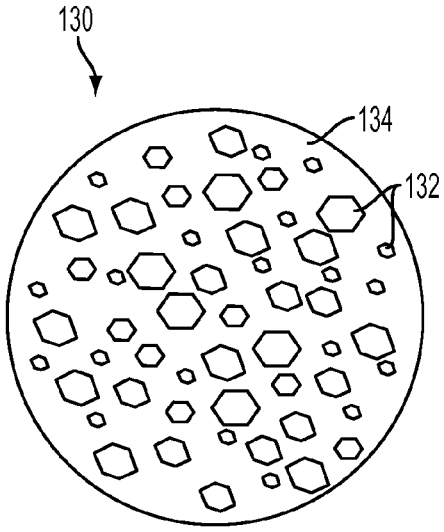
FIG. 3A is an enlarged simplified view illustrating how a microstructure of a particle-matrix composite material that includes superabrasive particles embedded in a matrix material may appear under magnification.

The cutting features 104 of the drill bit 100 comprise a particle-matrix composite material that includes superabrasive particles embedded within a matrix material. FIG. 3A is a simplified illustration of how a microstructure of such a particle-matrix composite material 130 may appear under magnification. As shown in FIG. 3A, particle-matrix composite material 130 may include superabrasive particles 132 embedded within a matrix material 134. The superabrasive particles 132 may comprise at least one of diamond particles and cubic boron nitride particles. The matrix material 134 may comprise a metal or a metal alloy. As non-limiting examples, the matrix material 134 may comprise a cobalt-based alloy, a nickel-based alloy, an iron-based alloy, a copper-based alloy, etc.

Figure 3B:
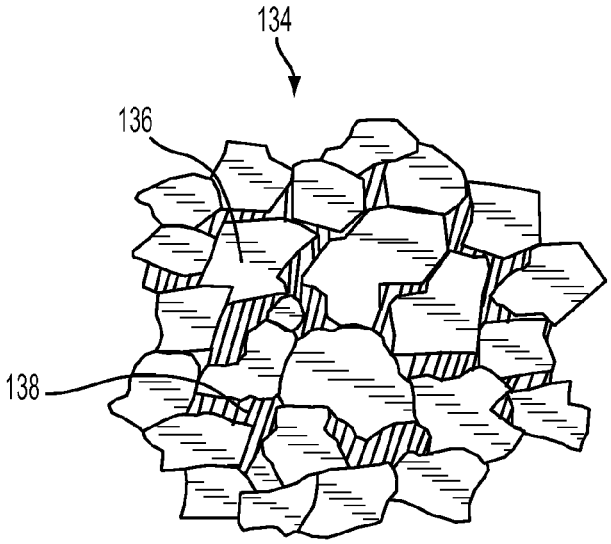
FIG. 3B is an enlarged simplified view illustrating how a microstructure of the matrix material of FIG. 3A may appear under further magnification.

Referring to FIG. 3B, in additional embodiments, the matrix material 134 itself may comprise a particle-matrix composite material that includes hard particles 136 embedded in a metal matrix material 138, though such hard particles 136 may be less hard than the superabrasive particles 132 (FIG. 3A). As a non-limiting example, the matrix material 134 may comprise a cemented tungsten carbide material including hard particles 136 comprising tungsten carbide particles embedded within a metal matrix material 138, such as a cobalt-based alloy, a nickel-based alloy, an iron-based alloy, a copper-based alloy, etc.

As previously mentioned, the cutting features 104 of the drill bit 100 of FIG. 1 may comprise such a particle-matrix composite material 130 as described with reference to FIGS. 3A and 3B. For example, in the non-limiting embodiment of FIG. 1, the posts 120 may be at least substantially comprised of such a particle-matrix composite material 130. The blades 122 also may comprise a particle-matrix composite material, although the particle-matrix composite material of the blades 122 may not include superabrasive particles in some embodiments. By way of example and not limitation, the blades 122 may comprise a cemented tungsten carbide material, which, as previously mentioned, may comprise tungsten carbide particles embedded within a metal matrix material, such as a cobalt-based alloy, a nickel-based alloy, an iron-based alloy, a copper-based alloy, etc. States another way, the blades 122 may comprise a material having a microstructure as shown in FIG. 3B, including hard particles 136 in a metal matrix material 138, but not including the superabrasive hard particles 132 of FIG. 3A. In additional embodiments, the blades 122 may be at least substantially comprised of a metal or metal alloy, and may not include a particle-matrix composite material.

Referring again to FIG. 4, in accordance with embodiments of the present disclosure, at least the cutting features 104 in the nose region 108 (FIG. 2) of the drill bit 100 may be configured to extend outwardly from the outer surfaces of the bit body 102 exposed within the fluid channels 114 by a relatively large distance D relative to previously known drill bits. For example, cutting features 104 in the nose region 108 of the drill bit 100 may extend from an outer surface 103 (FIG. 1) of the bit body 102 within the fluid channels 114 by an average distance of at least about 2.54 centimeters (1.00 inch). In some embodiments, cutting features 104 in the nose region 108 of the drill bit 100 may extend from the outer surface 103 by an average distance of at least about 3.175 centimeters (1.25 inches), at least about 3.810 centimeters (1.50 inches), at least about 4.445 centimeters (1.75 inches), or even at least about 5.080 centimeters (2.00 inches).

Referring again to FIG. 2, in an effort to improve the strength and/or toughness of the cutting features 104, a metal blank 116 may be provided within the interior of the bit body 102 that is formed from and comprises a metal alloy exhibiting relatively high strength and toughness. For example, such a metal blank 116 may comprise a steel alloy. The metal blank 116 may include integral extensions 118 that project into one or more interior regions within the cutting features 104 so as to improve the strength and/or toughness of the blades 122, and to avoid fracture of the cutting features 104 (e.g., the blades 122) during drilling. For example, in the embodiment shown in the Figures, a metal blank 116 may include extensions 118 that extend into the interior regions of the blades 122.

In addition, the cutting features 104 may be configured to be relatively aggressive cutting features. Referring again to FIG. 3A, the particle-matrix composite material 130 of the cutting features 104 may be formed to have a composition that exhibits certain physical properties and characteristics that result in aggressive cutting behavior during drilling. Generally speaking, an aggressive composition for a particle-matrix composite material 130 is formulated to cause the superabrasive particles 132 to protrude outward from the surrounding exposed surface of the matrix material 134 during drilling by a relatively high distance, such that each individual superabrasive particle 132 exhibits a relatively high depth of cut into the formation material. To this end, the superabrasive particles 132 may be selected to be relatively large, and the surrounding matrix material 134 may be selected to be relatively soft and to have a relatively low wear resistance. In this configuration, the surrounding matrix material 134 may wear away relatively easier during drilling to expose the superabrasive particles 132, and, due to the relatively large size of the superabrasive particles 132, the exposure of the superabrasive particles 132 may be increased to relatively higher distances before the superabrasive particles 132 become unsecured by the matrix material 134 and fall away.

As non-limiting examples, the superabrasive particles 132 may have a size of from about 150 particles (or "stones") per carat to about 70 particles per carat. More particularly, the superabrasive particles 132 may have a size of from about 120 particles per carat to about 70 particles per carat, or even from about 100 particles per carat to about 70 particles per carat. Additionally, the matrix material 134 may have a material composition that exhibits a wear number of about 3.0 or less when tested in accordance with ASTM International Test Method B611, entitled "Standard Test Method for Abrasive Wear Resistance of Cemented Carbides." More particularly, the matrix material 134 may have a material composition that exhibits a wear number of about 2.5 or less, or even about 2.2 or less. The wear-resistance of a cobalt-cemented tungsten carbide material may be decreased by increasing the volume percentage of cobalt metal matrix in the cobalt-cemented tungsten carbide material, for example. The wear-resistance of a cobalt-cemented tungsten carbide material also may be decreased by increasing the average grain size of the tungsten carbide grains, and/or the grains of the cobalt metal matrix.

Referring again to FIG. 4, by forming the cutting features 104 to stand relatively tall on the exterior surface of the drill bit 100 in at least the nose region 110 of the drill bit 100 (FIG. 2), and optionally also in the cone region 106 and or the shoulder region 110 of the drill bit 100, and by forming the cutting features 104 to be relatively aggressive, as discussed above, the drill bit 100 may be used to drill into a formation at a relatively high rate-of-penetration (ROP). Although the cutting features 104 may wear at a relatively high rate compared to previously known cutting features 104, since the cutting features 104 stand tall on the surface of the drill bit 100, they are capable of accommodating a high degree of wear before the drill bit 100 becomes unsuitable for use. The result is a drill bit 100 that may be used to drill at a relatively higher ROP without unduly sacrificing the service life of the drill bit 100.

Figure 4:
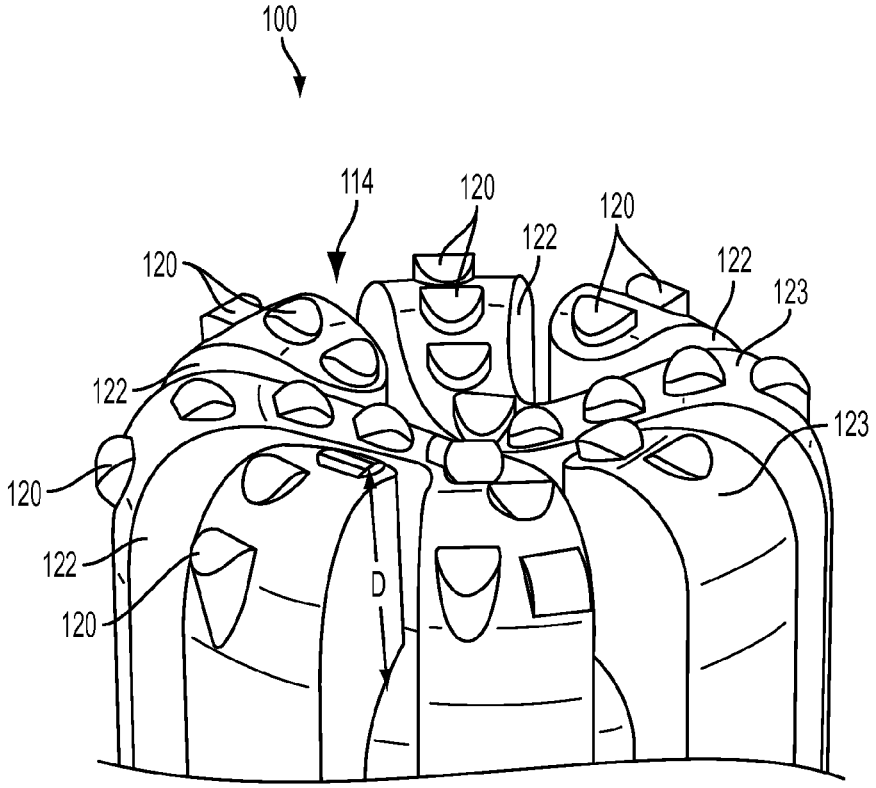
FIG. 4 is an enlarged view of a portion of the drill bit of FIG. 1.
Figure 5:
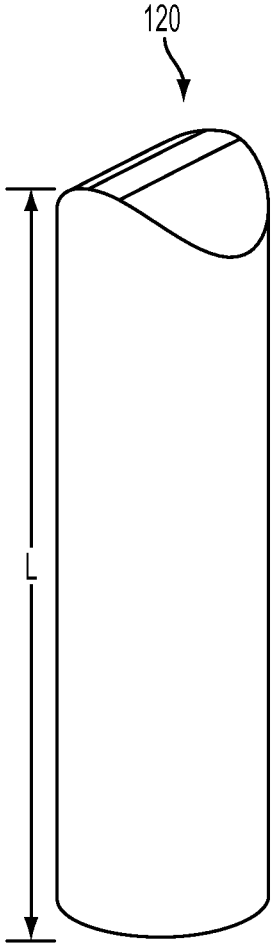
FIG. 5 is an enlarged stand-alone view of a superabrasive impregnated post of the drill bit of FIG. 1.

FIG. 5 is a stand-alone view of one of the posts 120 of FIGS. 1 and 4. As shown therein, the posts 120 may be elongated. For example, the posts 120 may have a length L of at least about 2.54 centimeters (1.00 inch), at least about 3.175 centimeters (1.25 inches), at least about 3.810 centimeters (1.50 inches), at least about 4.445 centimeters (1.75 inches), or even at least about 5.080 centimeters (2.00 inches). In some embodiments, the posts 120 may be generally cylindrical. The posts 120 may be fabricated using, for example, a hot isostatic pressing (HIP) process, or a hot pressing process. The posts 120 may be secured within receptacles formed in the blades 122 using, for example, a brazing process in which a molten braze alloy is provided at the interface between the posts 120 and the adjacent surfaces of the blades 122 within the receptacles and allowed to cool and solidify.

Some cutting features 104, or portions of cutting features 104 may be located within the gage region 112 (FIG. 2) of the drill bit 100. These cutting features 104 or portions of the cutting features 104 may be configured to be relatively more wear-resistant and less aggressive so as to reduce wear thereof in an effort to maintain the largest diameter of the drill bit 100 (which is defined by the diameter of the drill bit 100 in the gage region 112) at least substantially constant during drilling and reduce tapering of the diameter of the wellbore with increasing depth into the formation.

Thus, in some embodiments, cutting features 104 or portions of cutting features 104 that extend outwardly from the bit body 102 in the gage region 112 of the drill bit 100 may comprise another particle-matrix composite material 130 having a composition that differs from a composition of the particle-matrix composite material 130 of the cutting features 104 or portions of cutting features 104 in the cone region 106, the nose region 108, and/or the shoulder region 110. The particle-matrix composite material 130 of the cutting features 104 or portions of cutting features 104 in the gage region 112 may or may not include any superabrasive particles 132 (e.g., diamond or cubic boron nitride particles).

As one non-limiting example, the particle-matrix composite material 130 of the cutting features 104 or portions of cutting features 104 in the gage region 112 may comprise superabrasive particles 132, but the superabrasive particles 132 may be smaller compared to the superabrasive particles 132 in the particle-matrix composite material 130 of the cutting features 104 or portions of cutting features 104 in the cone region 106, the nose region 108, and/or the shoulder region 110 of the drill bit 100. As non-limiting examples, the superabrasive particles 132 in the particle-matrix composite material 130 of the cutting features 104 in the gage region 112 may have a size of about 150 particles per carat or smaller, about 175 particles per carat or smaller, or even about 200 particles per carat or smaller.

As another non-limiting example, the particle-matrix composite material 130 of the cutting features 104 or portions of cutting features 104 in the gage region 112 may not include any superabrasive particles 132. The particle-matrix composite material 130 of the cutting features 104 or portions of cutting features 104 in the gage region 112 may comprise a cemented tungsten carbide material in which, as previously discussed with reference to FIG. 3B, tungsten carbide hard particles 136 are embedded within a metal matrix material 138, such as a cobalt-based alloy, a nickel-based alloy, an iron-based alloy, a copper-based alloy, etc. The cemented tungsten carbide material of the particle-matrix composite material 130 of the cutting features 104 or portions of cutting features 104 in the gage region 112 may have a composition selected to be relatively wear-resistant. By way of example and not limitation, the cemented tungsten carbide material may include about 20 vol % or less, about 15 vol % or less, or even about 12 vol % or less of metal matrix material 138. Further, the tungsten carbide hard particles 136 may be relatively fine in the cemented tungsten carbide material, which may increase the wear-resistance of the cemented tungsten carbide material.

As non-limiting examples, the particle-matrix composite material 130 of the cutting features 104 or portions of cutting features 104 in the gage region 112 may have a material composition that exhibits a wear number of about 3.0 or more, about 3.2 or more, or even about 3.5 or more.

The bit body 102 of the superabrasive-impregnated rotary drill bit 100 may be fabricated using, for example, an infiltration process in which superabrasive particles 132 (e.g., diamond particles or cubic boron nitride particles) and other hard particles 136 (e.g., tungsten carbide particles) are mixed together and positioned in a mold cavity within a mold. The mold cavity may have a shape corresponding to the bit body to be formed. Molten metal matrix material 138 then may be cast into the mold and caused to infiltrate into the spaces between the superabrasive particles 132 and the other hard particles 136. The molten metal matrix material 138 then may be allowed to solidify, so as to form the bit body 102. If the bit body 102 is to include one or more metal blanks 116 as described with reference to FIG. 2, the one or more metal blanks 116 may be positioned within the mold cavity amongst the superabrasive particles 132 and the other hard particles 136 prior to infiltrating the molten metal matrix material 138. The molten metal matrix material 138 will then flow around the one or more metal blanks 116 and throughout the mixture of superabrasive particles 132 and other hard particles 136, and will be embedded in the composite material 130 formed by the metal matrix material 138, the superabrasive particles 132 and other hard particles 136 upon solidification of the metal matrix material 138.

The posts 120 may be fabricated separately from the rest of the bit body 102, and may be attached to the bit body 102 during the infiltration process as described above used to form the rest of the bit body 102. For example, the posts 120 may be fabricated by pressing and sintering a mixture of superabrasive particles 132, hard particles 136, and powder metal matrix material 138, after which the mixture may be pressed and sintered using, for example, a hot isostatic pressing (HIP) process to form the posts 120. The posts 120 thus formed may be positioned within the mold in which the bit body 102 is to be formed using an infiltration casting process as described above. In particular, the posts 120 may be positioned within the mold cavity amongst the superabrasive particles 132 and the other hard particles 136 prior to infiltrating the molten metal matrix material 138. The molten metal matrix material 138 will then flow around the posts 120 (and the one or more metal blanks 116, if present) and throughout the mixture of superabrasive particles 132 and other hard particles 136, and will be embedded in the composite material 130 formed by the metal matrix material 138, the superabrasive particles 132 and other hard particles 136 upon solidification of the metal matrix material 138.

In other embodiments, however, temporary displacement members may be provided that have a size and shape corresponding to the posts 120 to be attached to the bit body 102. The temporary displacements may comprise, for example, graphite, silica, alumina, or another ceramic material. The temporary displacement members then may be positioned in the mold cavity at the locations at which the posts 120 are to be provided in the drill bit, in a manner like that previously described in relation to the posts 120. The bit body 102 then may be formed around the temporary displacements using an infiltration casting technique, as previously described. After forming the bit body 102 around the temporary displacements, the temporary displacements may be removed using, for example, a grinding, drilling, or sandblasting process to form receptacles for the posts 120 at the locations at which the temporary displacements were previously disposed. Posts 120 formed separately as previously described then may be inserted into and secured within the receptacles in the bit body 102. The posts 120 may be secured within the receptacles using one or more of a brazing process, an adhesive, a welding process, and a press-fitting and/or shrink-fitting process such that mechanical interference retains the posts 120 within the receptacles in the bit body 102.

The methods described above for manufacturing the drill bit 100 are set forth as non-limiting examples, and other methods may also be employed to fabricate drill bits 100 of the present disclosure.

Additional non-limiting example embodiments of the disclosure are set forth below.

Embodiment 1: A superabrasive-impregnated earth-boring rotary drill bit, comprising: a bit body; and cutting features extending outwardly from the bit body in a nose region of the drill bit and defining a plurality of fluid channels extending over the bit body between the cutting features, the cutting features comprising a particle-matrix composite material including superabrasive particles embedded within a matrix material, the cutting features extending outwardly from the bit body in the nose region of the drill bit extending from the outer surface of the bit body within the fluid channels by an average distance of at least about 2.54 centimeters (1.00 inch).

Embodiment 2: The drill bit of Embodiment 1, wherein the superabrasive particles of the particle-matrix composite material have a size of from about 150 particles per carat to about 70 particles per carat.

Embodiment 3: The drill bit of Embodiment 2, wherein the superabrasive particles of the particle-matrix composite material have a size of from about 120 particles per carat to about 70 particles per carat.

Embodiment 4: The drill bit of Embodiment 3, wherein the superabrasive particles of the particle-matrix composite material have a size of from about 100 particles per carat to about 70 particles per carat.

Embodiment 5: The drill bit of any one of Embodiments 1 through 4, wherein the matrix material of the particle-matrix composite material has a material composition exhibiting a wear number of about 3.0 or less.

Embodiment 6: The drill bit of Embodiment 5, wherein the matrix material of the particle-matrix composite material has a material composition exhibiting a wear number of about 2.5 or less.

Embodiment 7: The drill bit of Embodiment 6, wherein the matrix material of the particle-matrix composite material has a material composition exhibiting a wear number of about 2.2 or less.

Embodiment 8: The drill bit of any one of Embodiments 1 through 7, further comprising cutting features extending outwardly from the bit body in a gage region of the drill bit, the cutting features in the gage region comprising another particle-matrix composite material having a composition differing from a composition of the particle-matrix composite material of the cutting features in the nose region of the drill bit.

Embodiment 9: The drill bit of Embodiment 8, wherein the another particle-matrix composite material comprises superabrasive particles having a size of about 150 particles per carat or smaller.

Embodiment 10: The drill bit of Embodiment 9, wherein the superabrasive particles of the another particle-matrix composite material have a size of about 175 particles per carat or smaller.

Embodiment 11: The drill bit of Embodiment 10, wherein the superabrasive particles of the another particle-matrix composite material have a size of about 200 particles per carat or smaller.

Embodiment 12: The drill bit of any one of Embodiments 8 through 11, wherein the another particle-matrix composite material has a composition exhibiting a wear number of about 3.0 or more.

Embodiment 13: The drill bit of Embodiment 12, wherein the another particle-matrix composite material has a composition exhibiting a wear number of about 3.2 or more.

Embodiment 14: The drill bit of Embodiment 13, wherein the another particle-matrix composite material has a composition exhibiting a wear number of about 3.5 or more.

Embodiment 15: The drill bit of any one of Embodiments 1 through 14, wherein the cutting features comprise at least one of segments, posts, and blades.

Embodiment 16: The drill bit of Embodiment 15, wherein the cutting features comprise posts and blades, the posts extending into the blades.

Embodiment 17: The drill bit of any one of Embodiments 1 through 16, wherein the superabrasive particles comprise at least one of diamond particles and cubic boron nitride particles.

Embodiment 18: A method of forming a superabrasive-impregnated earth-boring rotary drill bit, comprising: forming cutting features extending outwardly from the bit body in a nose region of the drill bit and defining a plurality of fluid channels extending over the bit body between the cutting features; forming the cutting features to comprise a particle-matrix composite material including superabrasive particles embedded within a matrix material; and forming the cutting features extending outwardly from the bit body in the nose region of the drill bit to extend from the outer surface of the bit body within the fluid channels by an average distance of at least about 2.54 centimeters (1.00 inch).

Embodiment 19: The method of Embodiment 18, further comprising selecting the superabrasive particles of the particle-matrix composite material to have a size of from about 150 particles per carat to about 70 particles per carat.

Embodiment 20: The method of Embodiment 19, further comprising selecting the superabrasive particles of the particle-matrix composite material to have a size of from about 120 particles per carat to about 70 particles per carat.

Embodiment 21: The method of Embodiment 20, further comprising selecting the superabrasive particles of the particle-matrix composite material to have a size of from about 100 particles per carat to about 70 particles per carat.

Embodiment 22: The method of any one of Embodiments 18 through 21, further comprising selecting the matrix material of the particle-matrix composite material to have a material composition exhibiting a wear number of about 3.0 or less.

Embodiment 23: The method of Embodiment 22, further comprising selecting the matrix material of the particle-matrix composite material to have a material composition exhibiting a wear number of about 2.5 or less.

Embodiment 24: The method of Embodiment 23, further comprising selecting the matrix material of the particle-matrix composite material to have a material composition exhibiting a wear number of about 2.2 or less.

Embodiment 25: The method of any one of Embodiments 18 through 24, further comprising: forming cutting features extending outwardly from the bit body in a gage region of the drill bit; and forming the cutting features in the gage region to comprise another particle-matrix composite material having a composition differing from a composition of the particle-matrix composite material of the cutting features extending outwardly from the bit body in the nose region of the drill bit.

Embodiment 26: The method of Embodiment 25, further comprising selecting the another particle-matrix composite material to include superabrasive particles having a size of about 150 particles per carat or smaller.

Embodiment 27: The method of Embodiment 26, further comprising selecting the superabrasive particles of the another particle-matrix composite material to have a size of about 175 particles per carat or smaller.

Embodiment 28: The method of Embodiment 27, further comprising selecting the superabrasive particles of the another particle-matrix composite material to have a size of about 200 particles per carat or smaller.

Embodiment 29: The method of any one of Embodiments 25 through 28, further comprising selecting the another particle-matrix composite material to have a composition exhibiting a wear number of about 3.0 or more.

Embodiment 30: The method of Embodiment 29, further comprising selecting the another particle-matrix composite material to have a composition exhibiting a wear number of about 3.2 or more.

Embodiment 31: The method of Embodiment 30, further comprising selecting the another particle-matrix composite material to have a composition exhibiting a wear number of about 3.5 or more.

Embodiment 32: The method of any one of Embodiments 18 through 31, further comprising forming the cutting features to comprise at least one of segments, posts, and blades.

Embodiment 33: The method of Embodiment 32, further comprising forming the cutting features to comprise posts and blades, the posts extending into the blades.

Embodiment 34: The method of any one of Embodiments 18 through 33, further comprising selecting the superabrasive particles to comprise at least one of diamond particles and cubic boron nitride particles.

Although the foregoing description contains many specifics, these are not to be construed as limiting the scope of the present invention, but merely as providing certain embodiments. Similarly, other embodiments of the invention may be devised that do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A superabrasive-impregnated earth-boring rotary drill bit, comprising:

a bit body; and cutting features extending outwardly from the bit body in a nose region of the drill bit and defining a plurality of fluid channels extending over the bit body between the cutting features, the cutting features comprising a particle-matrix composite material including superabrasive particles embedded within a matrix material, the cutting features extending from an outer surface of the bit body within the fluid channels by an average distance of at least about 2.54 centimeters (1.00 inch) in the nose region of the drill bit.

2. The drill bit of claim 1, wherein the superabrasive particles of the particle-matrix composite material have a size of from about 150 particles per carat to about 70 particles per carat.

3. The drill bit of claim 2, wherein the superabrasive particles of the particle-matrix composite material have a size of from about 120 particles per carat to about 70 particles per carat.

4. The drill bit of claim 3, wherein the superabrasive particles of the particle-matrix composite material have a size of from about 100 particles per carat to about 70 particles per carat.

5. The drill bit of claim 1, wherein the matrix material of the particle-matrix composite material has a material composition exhibiting a wear number of about 3.0 or less.

6. The drill bit of claim 5, wherein the matrix material of the particle-matrix composite material has a material composition exhibiting a wear number of about 2.5 or less.

7. The drill bit of claim 6, wherein the matrix material of the particle-matrix composite material has a material composition exhibiting a wear number of about 2.2 or less.

8. The drill bit of claim 1, further comprising cutting features extending outwardly from the bit body in a gage region of the drill bit, the cutting features in the gage region comprising another particle-matrix composite material having a composition differing from a composition of the particle-matrix composite material of the cutting features in the nose region of the drill bit.

9. The drill bit of claim 8, wherein the another particle-matrix composite material comprises superabrasive particles having a size of about 150 particles per carat or smaller.

10. The drill bit of claim 9, wherein the superabrasive particles of the another particle-matrix composite material have a size of about 175 particles per carat or smaller.

11. The drill bit of claim 8, wherein the another particle-matrix composite material has a composition exhibiting a wear number of about 3.0 or more.

12. The drill bit of claim 1, wherein the cutting features comprise at least one of segments, posts, and blades.

13. The drill bit of claim 12, wherein the cutting features comprise posts and blades, the posts extending into the blades.

14. A method of forming a superabrasive-impregnated earth-boring rotary drill bit, comprising:

forming cutting features extending outwardly from a bit body in a nose region of the drill bit and defining a plurality of fluid channels extending over the bit body between the cutting features;

forming the cutting features to comprise a particle-matrix composite material including superabrasive particles embedded within a matrix material; and wherein forming the cutting features extending outwardly from the bit body in the nose region of the drill bit further comprises forming the cutting features to extend from an outer surface of the bit body within the fluid channels by an average distance of at least about 2.54 centimeters (1.00 inch).

15. The method of claim 14, further comprising selecting the superabrasive particles of the particle-matrix composite material to have a size of from about 150 particles per carat to about 70 particles per carat.

16. The method of claim 14, further comprising selecting the matrix material of the particle-matrix composite material to have a material composition exhibiting a wear number of about 3.0 or less.

17. The method of claim 14, further comprising:

forming cutting features extending outwardly from the bit body in a gage region of the drill bit; and forming the cutting features in the gage region to comprise another particle-matrix composite material having a composition differing from a composition of the particle-matrix composite material of the cutting features extending outwardly from the bit body in the nose region of the drill bit.

18. The method of claim 17, further comprising selecting the another particle-matrix composite material to include superabrasive particles having a size of about 150 particles per carat or smaller.

19. The method of claim 18, further comprising selecting the another particle-matrix composite material to have a composition exhibiting a wear number of about 3.0 or more.

20. The method of claim 14, further comprising forming the cutting features to comprise posts and blades, the posts extending into the blades.

* * * * *